United States Patent [19]

Hazard

[11] 4,282,991

[45] Aug. 11, 1981

[54] DISPENSING CLOSURE SEALS

[75] Inventor: Robert E. Hazard, Kingstown, R.I.

[73] Assignee: Polytop Corporation, Slatersville, R.I.

[21] Appl. No.: 185,257

[22] Filed: Sep. 8, 1980

Related U.S. Application Data

[63] Continuation-in-part of Ser. No. 81,213, Oct. 2, 1979.

[51] Int. Cl.[3] ..... B67D 3/00; B67D 5/32

[52] U.S. Cl. ..... 222/531; 222/536

[58] Field of Search ..... 222/531, 532, 534, 536, 222/537, 538, 556

[56] References Cited

U.S. PATENT DOCUMENTS

| | | | |
|---|---|---|---|
| 1,372,115 | 3/1921 | Bennis | 222/536 |
| 2,717,776 | 9/1955 | Mart . | |
| 2,727,658 | 12/1955 | Mart . | |
| 2,793,795 | 5/1957 | Wilson et al. . | |
| 2,800,259 | 7/1957 | Wilson et al. . | |
| 2,828,895 | 4/1958 | Mart | 222/536 |
| 3,023,939 | 3/1962 | Gustafson . | |
| 3,283,967 | 11/1966 | Akers | 222/536 |
| 3,495,745 | 2/1970 | Akers . | |
| 3,655,099 | 4/1972 | Hazard | 222/538 X |
| 4,209,114 | 6/1980 | Wilson et al. | 222/536 |
| 4,219,138 | 8/1980 | Hazard | 222/534 |

FOREIGN PATENT DOCUMENTS

| | | | |
|---|---|---|---|
| 798900 | 7/1958 | United Kingdom | 222/531 |

OTHER PUBLICATIONS

Herkimer, *Engineer's Illustrated Thesaurus* 1952, pp. 344 & 345.

Schwarz et al., *Pictorial Handbook of Technical Devices,* 1971, pp. 374 & 375.

Palestrant, *Practical Pictorial Guide to Mechanisms and Machines,* 1956, pp. 60–65.

*Primary Examiner*—David A. Scherbel

*Attorney, Agent, or Firm*—Edward D. O'Brian

[57] ABSTRACT

Effective, easily manufactured seals for dispensing closures in which a spout is rotatably mounted on a cap can be created using an edge on an external surface of the cap to engage an end of the spout. This edge serves to create a seal. The end of the spout and the external surface adjacent to the edge have related cross-sectional configurations such that in all positions of the spout the end engages the edge in the same manner so as to form a seal.

4 Claims, 6 Drawing Figures

DISPENSING CLOSURE SEALS

CROSS-REFERENCE TO RELATED APPLICATIONS

This application is a continuation-in-part of the copending Hazard U.S. patent application Ser. No. 81,213 entitled "DISPENSING CLOSURE SEAL STRUCTURES" filed Oct. 2, 1979. The entire content of this copending application Ser. No. 81,213 is incorporated herein by reference.

BACKGROUND OF THE INVENTION

The invention set forth in this specification pertains to new and improved seal structures intended to be utilized within dispensing closures employing polyolefin parts and constructed in such a manner that when the parts are assembled with respect to one another one of the parts may be rotated relative to the other of the parts between open and closed positions. It is considered, however, that these seal structures may be utilized with other related devices.

Dispensing closures as indicated in the preceding discussion are normally constructed using two parts, one of which is a rotatable part serving as a bottle cap and the other of which is a rotatable part serving as a spout which can be manipulated without removing the bottle cap from a container. Such closures may be constructed using more than two parts; they are widely utilized in packaging many different types of liquid or semi-liquid type products. These closures have been widely utilized because they can be easily and conveniently manufactured at a comparatively nominal cost. In spite of this the utilization of dispensing closures has been somewhat limited by the problem of forming closures which would not leak when used with the various different materials.

This problem of leakage in dispensing closures constructed utilizing polyolefin parts has been much more severe than anyone who has not been directly involved in the dispensing closure field would ever imagine. Virtually since the inception of such closures leakage has continually been a problem. During the early days of these dispensing closures it was thought that leakage could be prevented by utilizing congruent parts in the areas of such closures adjacent to openings and the passages through the parts of such closures. This was found not to be the case, primarily as a result of what was once termed the "idiosyncrasies" of the polyolefin then used for manufacturing these closures—polyethylene. Because of shrinkage and other factors it was found virtually impossible to manufacture polyethylene to exacting tolerances necessary to form effective seals against many different comparatively hard to seal liquids.

Efforts at creating effective seals for dispensing closures as noted have led to the development of a number of different structures. Virtually all of such structures have involved shaping the bottom of the non-movable part within such closure in one manner or another so that the contact between the two parts would result in either an increased pressure between the parts or a temporary deformation serving to prevent leakage. It is considered that an understanding of this invention requires a detailed discussion of the partial O-ring, more or less blade shaped pressure pad and various other related sealing members or structures which have been utilized with dispensing closures as indicated in the preceding discussion.

As the field of such closures is developed more and more effective seals have been developed. As comparatively hard, but still somewhat deformable, somewhat resilient materials such as polypropylene and linear polyethylene have become available, these materials have been increasingly used in two-part dispensing closures as noted for a number of reasons. One very important one of these reasons relates to that fact that many purchasers of dispensing closures prefer closures made of these materials because of their surface appearances and characteristics.

Efforts to shift to the use of polypropylene and linear polyethylene in manufacturing dispensing closures as noted have been handicapped to a degree by the fact that these materials are not as resilient and flexible as the non-linear polyethylene previously employed in manufacturing the parts of these closures. As the result of the comparative rigidity with these materials, the seal structures previously employed have not always proved satisfactory. The degree of effectiveness of such seal structures is, of course, related to a multitude of factors in connection with the design of any specific dispensing closure.

One of these factors pertains to the relative sizes of the parts. There is increasingly a tendency to produce dispensing closures having comparatively large openings or passages in the parts employed. Generally speaking, the larger such parts are or the larger such openings are, the more difficulty there is in providing a seal member or structure which will effectively seal against leakage of various comparatively hard to seal liquids and semiliquids. It is to be recognized that this problem of leakage is quite involved because it involves not only surface irregularities and deformations, but it involves fluid tension considerations related to both the liquid or the like being sealed and the material or materials which contact one another so as to form a seal.

BRIEF SUMMARY OF THE INVENTION

From the preceding it is believed that it will be realized that there is a need for new and improved seal structures for use in dispensing closures in which the parts are formed from either polypropylene or linear polyethylene. A broad objective of the present invention is to fulfill this need. Thus, the invention is intended to provide dispensing closures which are constructed of comparatively hard, yet somewhat deformable, somewhat resilient polymer parts which can be manufactured at about the same cost as prior dispensing closures but which differ from prior dispensing closures in that leakage of such new closures is virtually unknown.

It is not to be assumed from the preceding that the invention is only directed toward the production of closures which can be described as non-leaking closures. An extremely important aspect of the invention which in some respects can be regarded as more important than the relative nonleaking aspects of such closures, relates to the production of such closures. Prior sealing structures which are relatively effective for use with dispensing closures formed of such comparatively hard polyolefins have been of shapes such that the dies for the production of parts of such closures have been relatively difficult to make and therefore relatively expensive. An important aspect of the present invention lies in the fact that the dies for the production of closures utilizing the present invention are relatively easy to make and are therefore less expensive than the dies previously used in manufacturing related dispensing closures.

The aforegoing objects are achieved and the aforegoing advantages are realized by providing a dispensing closure having a cap and a spout, said spout having a base shaped as a surface of revolution extending around an axis and a passage leading therethrough from said base, said cap having an external surface adjacent to said end of said base and an opening leading therethrough intercepting said external surface, said cap and said spout having cooperating means holding said cap and said spout so that said spout may be rotated between an open position in which said passage and said opening are aligned and a closed position in which said end overlies said opening, said cap including a sealing means formed on said external surface around said opening, said sealing means engaging said end of said spout so as to form a seal therewith at all times, in which the improvement comprises: said sealing means comprising an edge on said external surface which does not extend from said external surface and which is not recessed within said external surface, said external surface adjacent to said edge having a cross-sectional configuration such that in all positions of said end said edge engages said end in the same manner so as to form a seal with respect to said end.

BRIEF DESCRIPTION OF THE DRAWINGS

Because of the nature of the invention it is considered that it is best more fully described with reference to the accompanying drawings in which.

Figure 1:
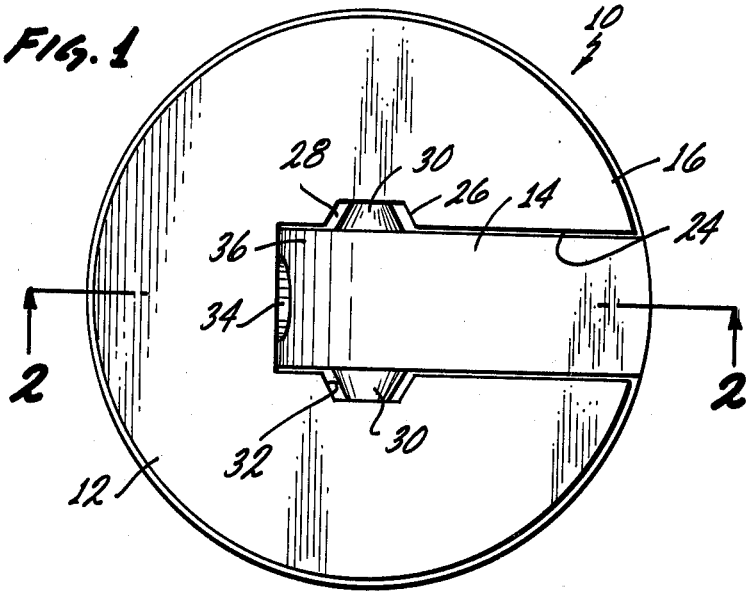
FIG. 1 is a top plan view of a dispensing closure constructed so as to utilize a presently preferred seal in accordance with this invention, the spout of this closure being shown in a closed position.

The structures illustrated in the drawings are constructed so as to utilize the operative concepts or principles of the invention verbally set forth in the appended claims. It is to be understood that these concepts or principles can be utilized in a variety of differently appearing structures which differ from those structures illustrated as to matters within the scope of routine design skill within the dispensing closure field.

DETAILED DESCRIPTION

Figure 2:
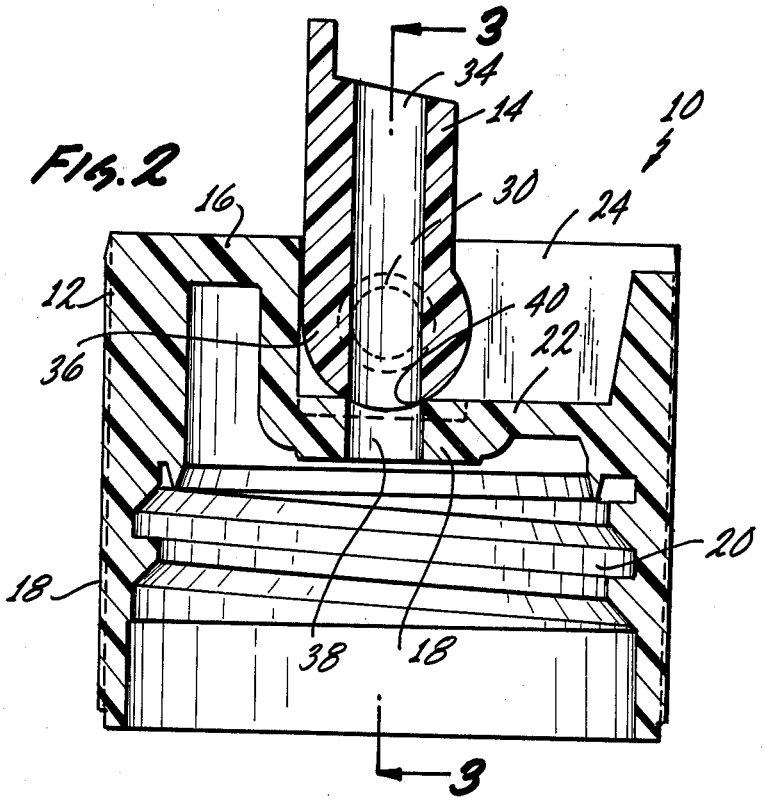
FIG. 2 is a partial cross-sectional view taken at line 2—2 of FIG. 1 in which the spout is shown in an open position instead of in a closed position as indicated in FIG. 1.
Figure 3:
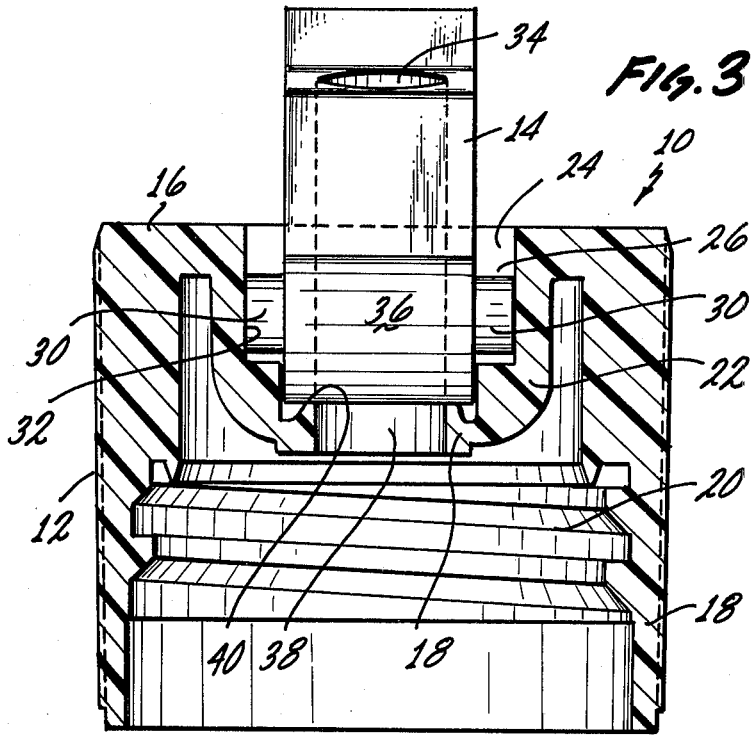
FIG. 3 is a partial cross-sectional view taken at line 3—3 of FIG. 2 at an enlarged scale.
Figure 4:
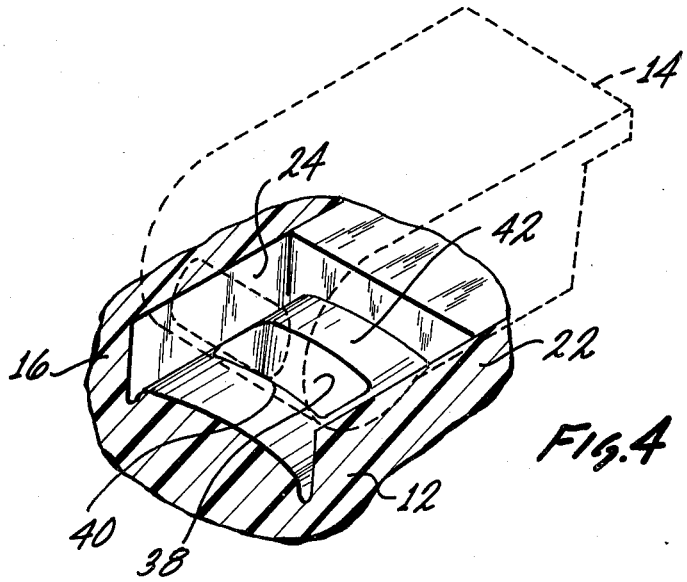
FIG. 4 is a partial isometric view of a part of the cap used in the closure shown in the preceding figures, parts of this cap being broken away in this figure for convenience of illustration and explanation.

In FIGS. 1 to 3 of the drawings there is shown a two-part dispensing closure 10 in accordance with this invention having a unitary cap or cap part 12 and a unitary spout or spout part 14. These parts 12 and 14 are preferably manufactured in accordance with conventional injection molding techniques out of various known forms of polyethylene, polypropylene or the like. It is considered particularly significant that satisfactory closures such as the closure 10 in accordance with this invention can be manufactured out of a substantially rigid material capable of limited temporary deformation in response to pressure such as linear polyethylene or polypropylene. In the past the construction of seals in closures reasonably corresponding to the closure 10 in which the parts corresponding to the parts 12 and 14 have been manufactured out of such materials has been a significant problem in the dispensing closure industry.

In accordance with conventional practice the cap 12 includes a top 16 which is integral with a dependent internally threaded skirt 18. The skirt 18 is provided with internal threads 20 or the equivalent for mounting the skirt 18 on a container (not shown). An internal sealing means 22 is provided within the skirt 18 for the purpose of forming a seal with such a container. Within the top 16 there is provided an elongated slot-like groove or cavity 24 having an enlarged end 26. Adjacent to this end 26 restricted entrances 28 are provided within the top 16 so that known, aligned trunnions 30 on the spout 14 may be "popped" or "snapped" into bearing cavities 32 formed in the top 16 beneath the entrance 28.

When the spout 14 is assembled in this manner on the cap 12 this spout 14 may be manipulated between a closed position as shown in FIG. 1 and an open position as indicated in FIG. 2. In this closed position a passage 34 extending through the spout 14 from a cylindrical end 36 on the spout 14 is located transversely to a cylindrical opening 38 extending through the top 16 into the end 26 of the groove 24. In this closed position the end 36 fits against an edge 40 located generally within the groove 24 so as to close off this opening 38. In the open position the edge 40 still fits against the end 36 so as to form a seal therewith. In this case this seal extends around the extremity (not separately numbered) of the opening 38 at the end 36.

The critical aspect of the present invention lies in the shape and configuration of this edge 40. In the past it has been known to utilize various different sealing rings in roughly the "area" in which the edge 40 is present so as to fit against ends of spouts in order to form a seal therewith at all times. Such sealing rings have been of various different shapes and configurations. In effect the edge 40 herein described is a new and improved type of sealing ring or sealing means for use in closures reasonably corresponding to the closure 10.

This edge 40 is located so as to be contiguous with and in effect a part of what may be referred to as an external surface 42 formed in the base or bottom of the groove or cavity 24. As far as the present invention is concerned the configuration of this surface 42 is only important immediately adjacent to the opening 38. For convenience of manufacturing a die for the production of caps 12 the surface 42 should constitute the entire bottom of the groove or cavity 24. This particular surface 42 is an upwardly bowed cylindrical surface formed about an axis (not shown). To a degree the shape of this surface 42 determines the precise shape and configuration of the edge 40. The remainder of this shape and configuration of this edge 40 is determined by the shape of the end 36. With the specific closure 10 when the surface 42 is cylindrical the end 36 must also have a cylindrical shape. It will be realized that this end 36 must also be shaped so that this end 36 has its axis (not shown) coincident with the axis (not shown) of rotation of the spout 14. In addition in this case the closure 10 must be constructed so that the radius of the end 36 is the same as the radius of the surface 42.

The shape of the edge 70 can be defined as the shape determined by the intersection of two cylinders of equal diameter located with respect to one another so that their axes (not shown) both intersect the axis (not shown) of the opening 38 at a right angle to the axis of the opening 38. Further, the axis of the end 36 and the surface 42 must be located so that they are transverse or at right angles to one another when viewed along the axis of the opening 38.

The shape of the edge 40 as determined by the intersection of the two cylinders as indicated in the preceding acts to determine automatically the diameter of the openings 38. Although a reasonable sealing action can be achieved when this opening 38 is of slightly less diameter than the diameter of the cylinder of maximum size capable of being fitted within the edge 40, such a structure is not considered desirable with the present invention because of the fact that a curved, beveled surface having width adjacent to the edge 40 provides an opportunity for some shrinkage of polymer material which may interfere with a desired seal being obtained.

For these reasons it is considered that it is preferable with the invention to have the diameter of the opening 38 equal to the maximum diameter which can be accommodated within the edge 40 so that in cross-section this edge 40 is essentially an intersection between two curved planes or surfaces which are transverse or reasonably transverse to one another. The passage 34 may be of any shape or dimension capable of fitting within the edge 40 when the spout 14 is in an open position. This passage 34 is normally a cylindrical passage of slightly less diameter than the diameter of the opening 38 adjacent to the edge 40 so that this edge 40 will fit against the end 36 so as to form a seal with it when the spout 14 is in an open position.

In theory it is possible to form a seal between the spout 14 and the cap 12 along the edge 40 in the absence of any type of temporary material deformation either in the end 36 or adjacent to the edge 40. However, it is well known that theory and practice do not always precisely agree, particularly when one is dealing with the problems involved in accurately forming precision parts from various commercially available grades of polymers as indicated in the preceding discussion. Even a specific grade of a polymer obtained from a specific manufacturer will normally vary from time to time to a sufficient extent so that parts produced from such a polymer under identical conditions will vary slightly. Further, various minor changes occur in the operation of injection molding machines will result in minor dimensional changes. As a result of these factors it is considered undesirable to construct the closure 10 so that there is no interference or temporary material deformation at or adjacent to the edge 40.

It is preferred to relate the dimensions of the external surface 42, the cylindrical end 36 and the bearing cavities 32 in such a manner to provide for a very limited amount of interference between the end 36 and the edge 40 along or at the surface 42. The precise amount of such interference is a matter of choice. At this time it is considered that the amount of such interference as measured in the direction of the axis of the opening 38 should be at least about 0.002 in. (0.01 cm.). If this dimension were any less in effect the closure 10 would rely upon what was referred to in the preceding discussion as a theoretical seal. On the other hand it is considered that this interference should be no more than about 0.010 in. (0.03 cm.) since any greater degree of contact between the end 36 and the edge 40 would make it comparatively difficult to rotate the spout 14 and would not significantly benefit or improve the seal achieved at the edge 40. Indeed, there is a chance that any greater amount of interference might to a degree tend to cause sufficient deformation within and adjacent to the surface 42 and along the edge 40 to detrimentally effect the desired sealing action.

Generally speaking no significant deformation will occur in the end 36 as a result of the amount of interference indicated as desirable in the preceding discussion. This is because of the comparatively massive character of the end 36. The physical properties of the materials as noted in the preceding will normally allow the parts specified to accommodate the amount of interference specified without causing any damage, even though such interference may to a degree place something of a strain on various parts of the closure 10. With interference of the amount noted normally such strains will not be sufficiently high to interfere with the holding action exerted against the trunnions 30 in the areas of the entrances 28 in the bearing cavities 32 and will not be sufficient to cause any significant or noticeable amount or degree of stress cracking.

It is not to be assumed from the preceding that the invention is limited to closures utilizing a surface corresponding to the surface 42 which is cylindrical and an end corresponding to the end 36 which is cylindrical. Broadly, the present invention is applicable to any geometric system employing "parts" related to one another so that an edge corresponding to the edge 40 in all positions of the end corresponding to the end 36 engages this end 36 in the same manner so as to form a seal with respect to it. It is always necessary for the end 36 to be shaped as a surface of revolution.

Figure 5:
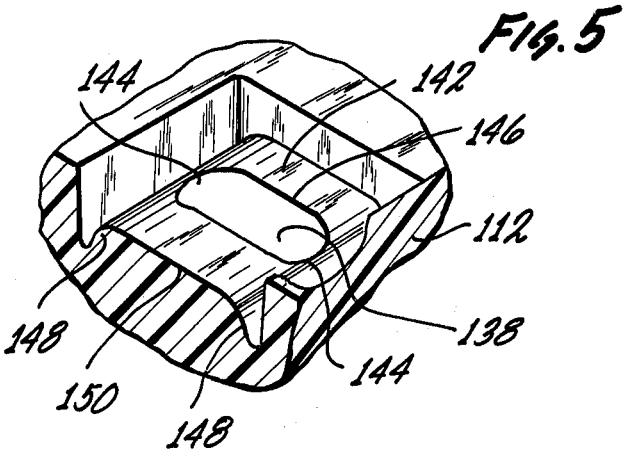
FIG. 5 is a view corresponding to FIG. 4 of a modified form of closure in accordance with the present invention.
Figure 6:
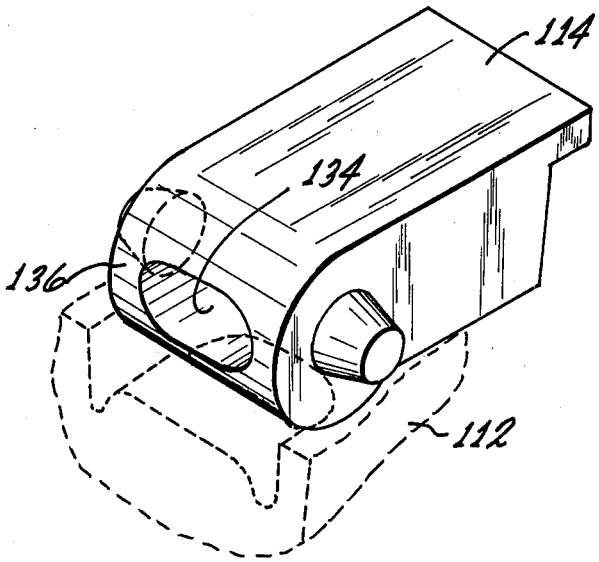
FIG. 6 is an isometric view of a spout used in this modified form of closure.

The requirements of such a geometric system make it possible to consider utilizing structures in which two right circular cones are used to define an edge corresponding to the edge 40. In theory various "exotic" curved shapes can be utilized with the present invention. As a practical matter, however, because of the costs in producing tooling the present invention will be limited to the use of a structure in which the edge 40 in a closure 10 is determined as indicated in the preceding discussion or to the use of a closely related structure employing a cap or cap part 112 as indicated in FIG. 5 with a spout or spout part 114 as indicated in FIG. 6.

A complete closure employing such a spout 114 assembled upon such a cap 112 is not illustrated in the drawing since it is not considered that the illustration of such a complete closure is necessary for an understanding of a modified closure structure using the spout 114 and the cap 112. Inasmuch as such a closure formed using the cap 112 and the spout 114 would be very closely related to the closure 10 previously described, and inasmuch as various parts of the cap part 112 and the spout 114 are the same or substantially the same as corresponding parts of the cap 12 and spout 14 previously described, those parts of the cap 112 and the spout 114 which are of a corresponding character are not separately described herein and are indicated in the remainder of this specification and in the accompanying drawings by the numerals previously used to designate such parts preceded by the numeral 1. Except as noted the cap 12 is the same as the cap 112 and the spout 14 is the same as the spout 114.

The essential difference between the cap 112 and the cap 12 previously described relates to the opening 138 utilized in the cap 112. This opening 138 has two semicylindrical ends 144 which are joined by flat walls 146. These walls 146 extend tangentially with respect to these ends 144. The ends 144 are of the same diameter and have parallel axes (not shown). The cap 112 is also different from the cap 12 previously described in that it employs an external surface 142 which consists of two cylindrical extremities 148 of the same diameter and having parallel axes (not shown) joined by a flat surface 150 extending tangentially to these extremities 148.

The opening 138 is located so that an imaginary plane (not shown) passing through the axes of the ends 144 is or would be located transversely to a similar imaginary plane extending or passing between the axes of the extremities 148. Further, the opening 138 is located so that the intersection of such two planes is parallel to and spaced from the axis of the end 136 of the spout 114. In addition, the axis of the end 136 is located in the imaginary plane passing through the parallel axes of the semicylindrical ends 144 and is parallel to the intersection of the two planes noted in the preceding discussion.

The modified spout 114 differs from the spout 14 previously discussed solely in that the passage 34 is modified so as to correspond in shape and configuration to the opening 138. When the spout 114 is in an open position on the cap 112 the edge 140 fits against the end 136 completely around the opening 138 so as to form a seal therewith. If desired, the passage 134 may be significantly smaller than the opening 138 and may even differ in configuration from the opening 138.

It is believed that it will be apparent that those skilled in the art of the design and construction of dispensing closures that the present invention possesses distinct advantages. The simplicity of the edge-type seal utilized in the closures described is important from several different standpoints. It is important since it enables significant cost savings to be achieved in the construction of injection molds for the production of closures in accordance with this invention. Such molds are both simpler and less expensive to make than molds constructed so as to produce prior sealing rings.

Further, the present invention is important because of the simplicity of a sealing edge as described. As a result of this edge not being of a comparatively "thin" or blade-like cross-sectional configuration there is substantially no danger of polymer material not filling out this edge during a molding cycle. Because of the nature of this edge there is virtually no chance of this edge being damaged for one reason or another in the manufacture and/or assembly of closures as described.

While the particular closures described in the preceding are two-part closures constructed in such a manner that the parts can be snapped together, it is not to be assumed that the invention is limited to use with such two-part closures. The broad concepts of the present invention can be employed with rotatable spout dispensing closures utilizing more than two parts. Three-part rotatable spout dispensing closures are known. Because of this it is not considered necessary to specifically illustrate such closures in connection with the present invention. When constructed in accordance with this invention such three-part closures will utilize a geometry as indicated in the preceding for sealing purposes. Depending upon the specific construction employed in a three-piece closure an amount of interference as indicated in the preceding discussion may be created between the spout and an adjacent portion either during the manufacture of such a closure or upon such a closure being torqued down upon a container neck.

I claim:

1. A dispensing closure having a cap and a spout, said spout having a base shaped as a surface of revolution extending around an axis and a passage leading therethrough from said base, said cap having an external surface adjacent to said end of said base and an opening leading therethrough intercepting said external surface, said external surface being convex and having a uniform cross-sectional configuration adjacent to said opening, said cap and said spout having cooperating means holding said cap and said spout so that said spout may be rotated between an open position in which said passage and said opening are aligned and a closed position in which said end overlies said opening, said cap including a sealing means formed by said external surface around said opening, said sealing means engaging said end of said spout so as to form a seal therewith at all times, in which the improvement comprises:

said sealing means comprising an edge on said external surface, the base of said spout only touching said edge to form a seal, said external surface adjacent to said edge having a cross-sectional configuration such that in all positions of said end said edge engages said end in the same manner so as to form a seal with respect to said end.

2. A dispensing closure as claimed in claim 1 wherein:

said surface of revolution is a cylindrical surface, said external surface is also a cylindrical surface, the radii of said surface of revolution and said external surface are equal, said opening is a cylindrical opening having an axis, said opening being located so that the axis of said opening intersects at a right angle both the axis of said surface of revolution and the axis of said external surface, the axis of said surface of revolution being transverse to the axis of said external surface around the axis of said opening.

3. A dispensing closure as claimed in claim 1 wherein:

said surface of rotation is a cylindrical surface, said external surface consists of two cylindrical extremities of the same diameter having parallel axes joined by a flat surface extending tangentially to said cylindrical extremities, the radii of said surface of revolution and of both of said cylindrical extremities of said external surface are equal, said opening has semicylindrical ends of the same diameter having parallel axes joined by parallel, flat walls extending tangentially to said cylindrical ends, said opening being located so that a plane passing through the axes of said ends is located transversely to a plane extending between the parallel axes of said cylindrical extremities of said external surface so that the intersection of said two planes is parallel to and spaced from the axis of said surface of revolution, said axis of said surface of revolution being located in the plane passing through the parallel axes of said semicylindrical ends.

4. A dispensing closure as claimed in claim 2 or claim 3 wherein:

at least the portions of said cap and said spout which engage one another are formed of a material which is rigid and which is capable of limited temporary deformation in response to applied pressure, said cap and said spout being located with respect to one another so that there is from about 0.002 to about 0.010 in. interference between said spout and said cap.

* * * * *